US011795604B2

(12) United States Patent
Donar, Jr. et al.

(10) Patent No.: US 11,795,604 B2
(45) Date of Patent: Oct. 24, 2023

(54) ADDITIVE DISPENSING SYSTEM FOR A WASHING MACHINE APPLIANCE

(71) Applicant: Haier US Appliance Solutions, Inc., Wilmington, DE (US)

(72) Inventors: Karlarrious Dawain Donar, Jr., Louisville, KY (US); Christopher Gene Vowels, Cox's Creek, KY (US); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 68 days.

(21) Appl. No.: 17/399,741

(22) Filed: Aug. 11, 2021

(65) Prior Publication Data

US 2023/0050502 A1 Feb. 16, 2023

(51) Int. Cl.

| | |
|---|---|
| ***D06F 39/02*** | (2006.01) |
| ***D06F 39/08*** | (2006.01) |
| ***D06F 23/04*** | (2006.01) |

(52) U.S. Cl.

CPC ..... *D06F 39/028* (2013.01); *D06F 23/04* (2013.01); *D06F 39/088* (2013.01)

(58) Field of Classification Search

None

See application file for complete search history.

(56) References Cited

U.S. PATENT DOCUMENTS 7,430,937 B2 10/2008 Rotter

FOREIGN PATENT DOCUMENTS

| | | | | |
|---|---|---|---|---|
| CN | 211796312 U | | 10/2020 | |
| EP | 2345758 A1 | * | 7/2011 | ..... D06F 39/02 |
| KR | 101158796 B1 | | 6/2012 | |
| KR | 102205483 B1 | | 1/2021 | |
| WO | WO2016127497 A1 | | 8/2016 | |

OTHER PUBLICATIONS

Espacenet translation KR102205483, Samsung Washing machine having detergent feeding device (Year: 2021).*

* cited by examiner

*Primary Examiner* — Cristi J Tate-Sims

(74) *Attorney, Agent, or Firm* — Dority & Manning, P.A.

(57) ABSTRACT

A washing machine appliance defines a mutually perpendicular vertical direction, lateral direction, and transverse direction. The washing machine appliance includes a cabinet having an opening defined in and through a top cover thereof. A wash tub is mounted within the cabinet and a wash basket is mounted rotatably within the wash tub. The wash basket is accessible through the opening in the top cover. A dispensing assembly includes a dispenser box mounted above the wash tub, a shower plate positioned within the dispenser box and defining a plurality of water supply apertures, lateral suspension arms that extend downward from the shower plate along a vertical direction, and a detergent drawer defining one or more detergent reservoirs, the detergent drawer being directly supported by the lateral suspension arms.

20 Claims, 7 Drawing Sheets

ADDITIVE DISPENSING SYSTEM FOR A WASHING MACHINE APPLIANCE

FIELD OF THE INVENTION

The present subject matter relates generally to washing machine appliances and more particularly to dispensing assemblies of washing machine appliances.

BACKGROUND OF THE INVENTION

Washing machine appliances generally form a wash fluid to clean clothing articles disposed within a wash basket of the appliance. The wash fluid can include water and various fluid additives, e.g., detergent, fabric softener, and/or bleach. The fluid additives can be mixed with water within a wash tub of the appliance in order to form the wash fluid.

To introduce fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a dispensing assembly may include a detergent drawer that is mounted to a top cover of a vertical axis washing machine appliance and can receive a fluid additive and direct the fluid additive into a wash tub of the appliance. For example, the detergent drawer may be slid out of a dispenser box, filled with wash additive, and then slid back into the dispenser box prior to an operating cycle. However, conventional detergent drawers do not slide easily into and out of the dispenser box. For example, these detergent drawers may have a tendency to bind or wabble within the dispenser box, resulting in consumer dissatisfaction, spilled wash additive, improper dispensing, etc.

Accordingly, a washing machine appliance with improved features for storing and dispensing volumes of fluid additive would be useful. More particularly, a dispensing assembly that provides improved drawer movement for improved consumer feel and satisfaction would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided. The washing machine appliance defines a vertical direction, a lateral direction, and a transverse direction, the vertical, lateral, and transverse directions being mutually perpendicular. The washing machine appliance includes a wash tub positioned within a cabinet, a wash basket rotatably mounted within the wash tub and defining a wash chamber configured for receiving a load of clothes, and a dispensing assembly for providing a flow of wash fluid into the wash tub. The dispensing assembly includes a dispenser box mounted above the wash basket, a shower plate positioned within the dispenser box and defining a plurality of water supply apertures, lateral suspension arms that extend downward from the shower plate along the vertical direction, and a detergent drawer defining one or more detergent reservoirs and being directly supported by the lateral suspension arms such that water supplied through the water supply apertures is directed into the one or more detergent reservoirs.

In another exemplary embodiment, a dispensing assembly for providing a flow of wash fluid into a wash tub of a washing machine appliance is provided. The dispensing assembly includes a dispenser box mounted above the wash tub, a shower plate positioned within the dispenser box and defining a plurality of water supply apertures, lateral suspension arms that extend downward from the shower plate along a vertical direction, and a detergent drawer defining one or more detergent reservoirs, the detergent drawer being directly supported by the lateral suspension arms such that water supplied through the water supply apertures is directed into the one or more detergent reservoirs.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
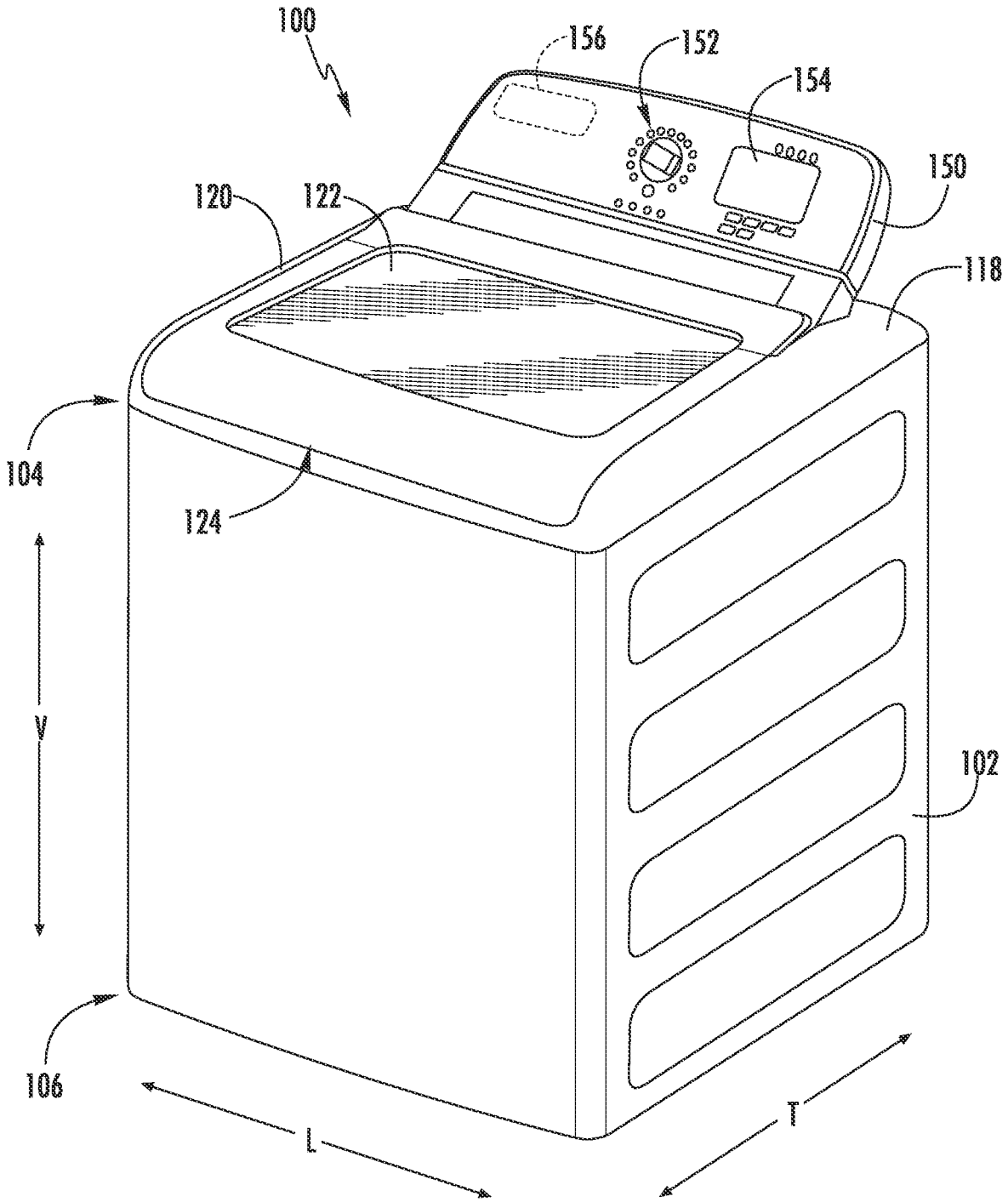
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "clothing," "articles," and the like may include but need not be limited to fabrics, textiles, garments, linens, papers, or other items which may be cleaned, dried, and/or otherwise treated in a laundry appliance. Furthermore, the terms "load" or "laundry load" refers to the combination of clothing that may be washed together in a washing machine or dried together in a dryer appliance and may include a mixture of different or similar articles of clothing of different or similar types and kinds of fabrics, textiles, garments and linens within a particular laundering process.

Figure 2:
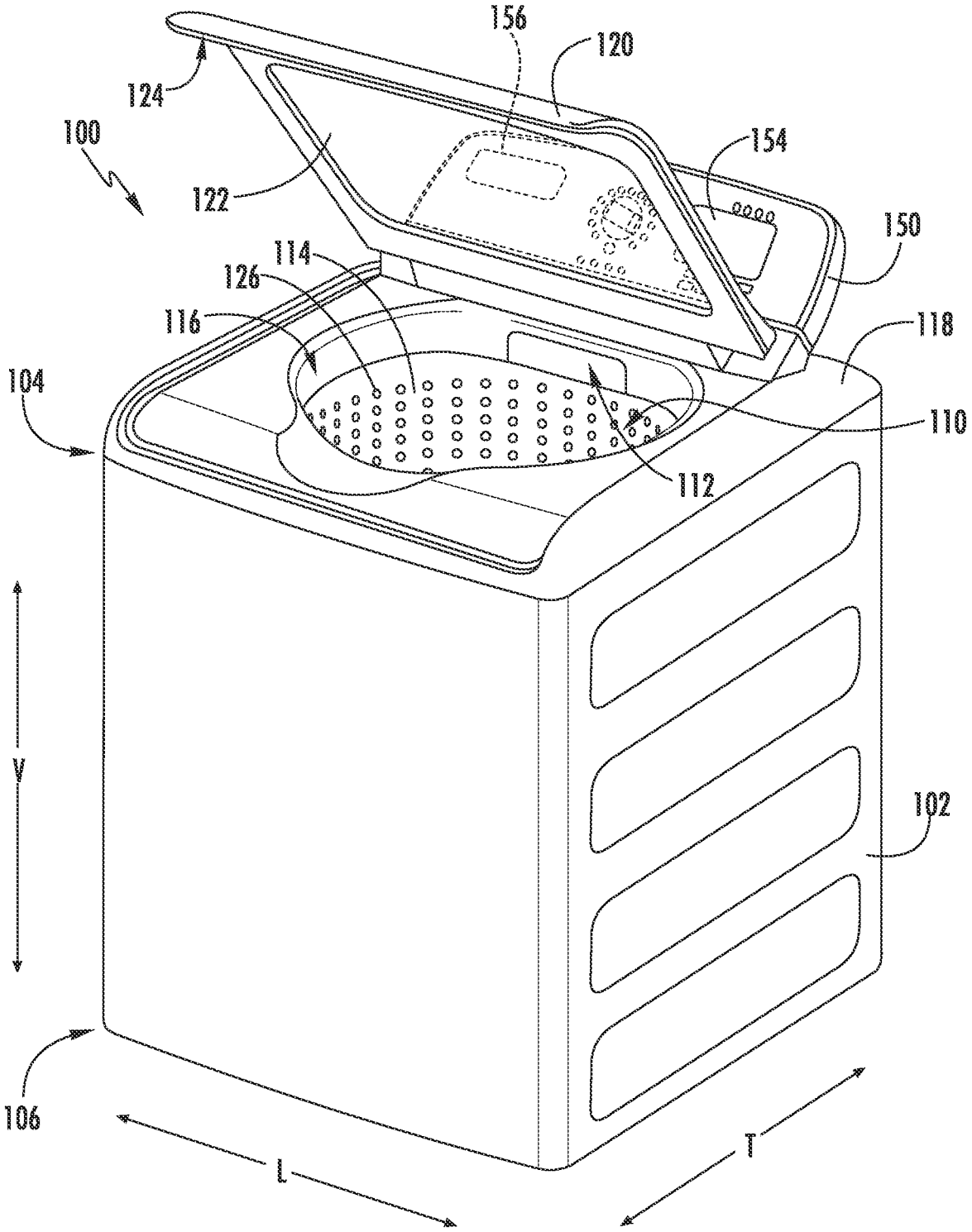
FIG. 2 provides a perspective view of the exemplary washing machine appliance of FIG. 1 with the door of the exemplary washing machine appliance shown in an open position.
Figure 3:
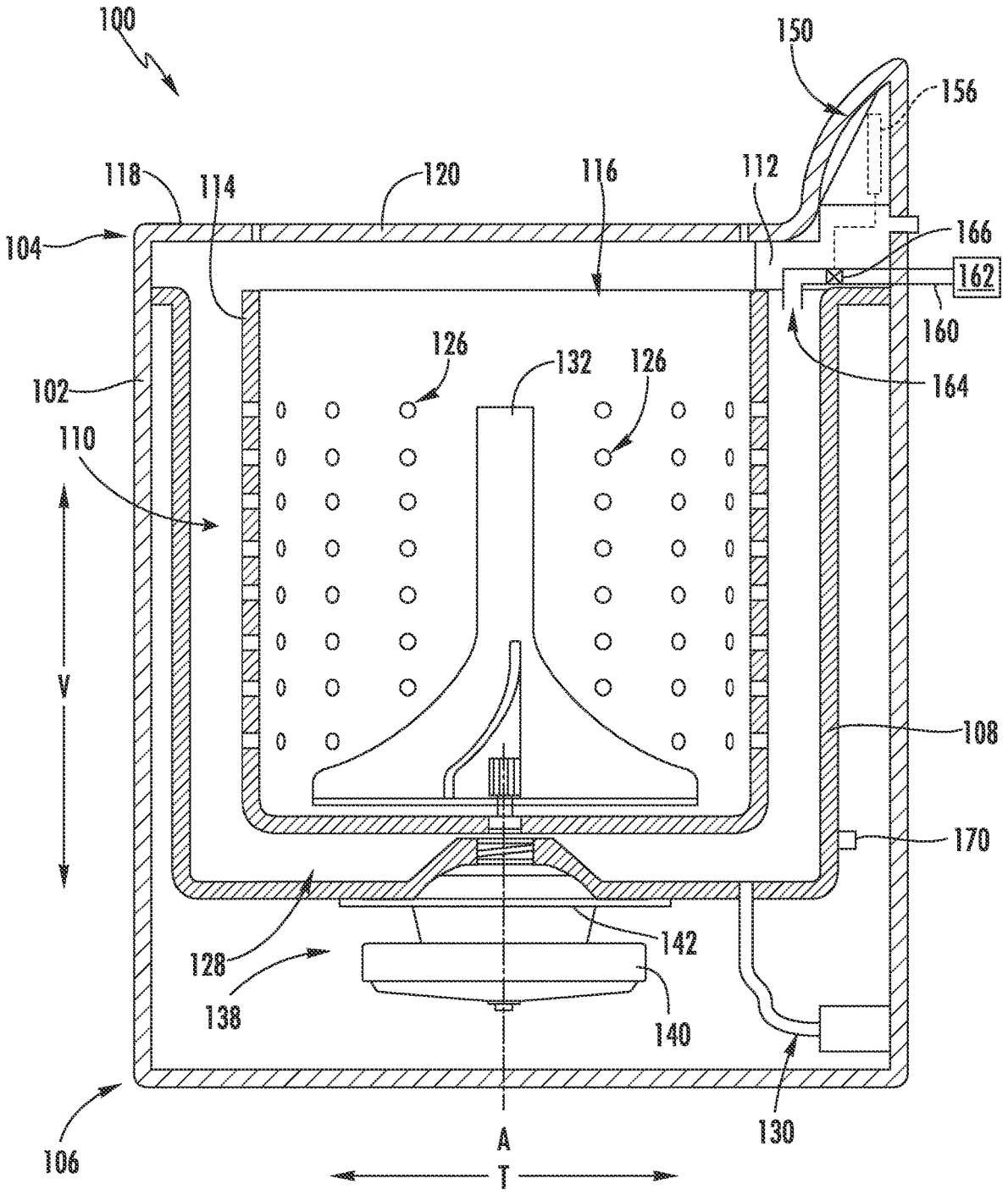
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly 138 in mechanical communication with wash basket 114 to selectively rotate wash basket 114 (e.g., during an agitation or a rinse cycle of washing machine appliance 100). In addition, drive assembly 138 may also be in mechanical communication with agitation element 132. In this manner, drive assembly 138 may be configured for selectively rotating or oscillating wash basket 114 and/or agitation element 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 100 includes a water supply conduit 160 that provides fluid communication between a water supply source 162 (such as a municipal water supply) and a discharge nozzle 164 for directing a flow of water into wash chamber 110. In addition, washing machine appliance 100 includes a water fill valve or water control valve 166 which is operably coupled to water supply conduit 160 and communicatively coupled to controller 156. In this manner, controller 156 may regulate the operation of water control valve 166 to regulate the amount of water within wash tub 108. In addition, washing machine appliance 100 may include one or more pressure sensors 170 for detecting the amount of water and or clothes within wash tub 108. For example, pressure sensor 170 may be operably coupled to a side of tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. After articles disposed in wash basket 114 are cleaned and/or washed, the user can remove the articles from wash basket 114, e.g., by reaching into wash basket 114 through opening 116.

Referring now to FIGS. 4 through 8, a dispensing assembly 200 will be described according to an exemplary embodiment of the present subject matter. Dispensing assembly 200 may be used with washing machine appliance 100, e.g., as a part of or replacing primary dispenser 112 described above. In addition, dispensing assembly 200 may be used in other washing machine appliances, including both vertical and horizontal axis washing machine appliances. As described in detail below, dispensing assembly 200 includes features for improved consumer interaction with dispensing assembly, e.g., to supply detergent, wash additives, etc.

In general, dispensing assembly 200 may be fluidly coupled with a suitable water supply, e.g., such as water supply source 162 via water supply conduit 160. In addition, it should be appreciated that dispensing assembly may include one or more flow distribution manifolds, flow regulating valves (e.g., such as water control valve 166), nozzles, conduits, or other flow regulating features for regulating a flow of water through dispensing assembly 200. Moreover, it should be appreciated that dispensing assembly 200 may be fluidly coupled with a bulk dispenser in appliances that include bulk dispensing features.

As illustrated, dispensing assembly 200 includes a dispenser box 202 that is mounted above wash tub 108 and/or wash basket 114. In general, dispenser box 202 may be a housing for receiving various components of dispensing assembly 200. In addition, dispenser box 202 may define a bottom floor 204 that is sloped downward toward wash basket 114. In this manner, dispenser box 202 is generally configured for directing a flow of wash fluid generated within dispensing assembly 200 into wash basket 114, as will be described in more detail below.

Figure 4:
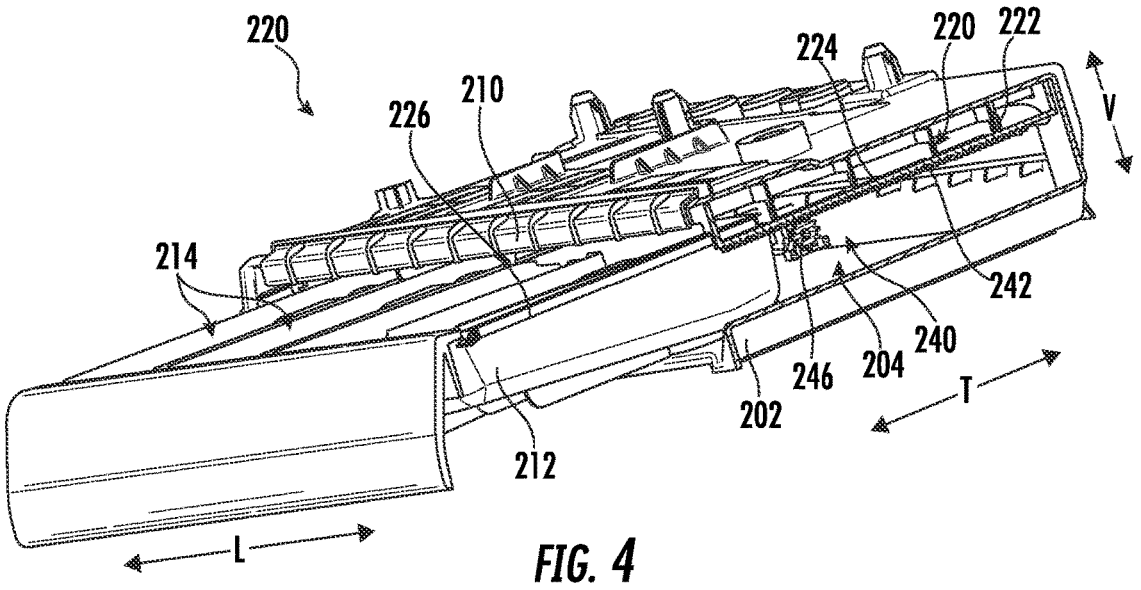
FIG. 4 provides a perspective view of a dispensing assembly that may be used with the exemplary washing machine appliance of FIG. 1 according to exemplary embodiments of the present subject matter.
Figure 5:
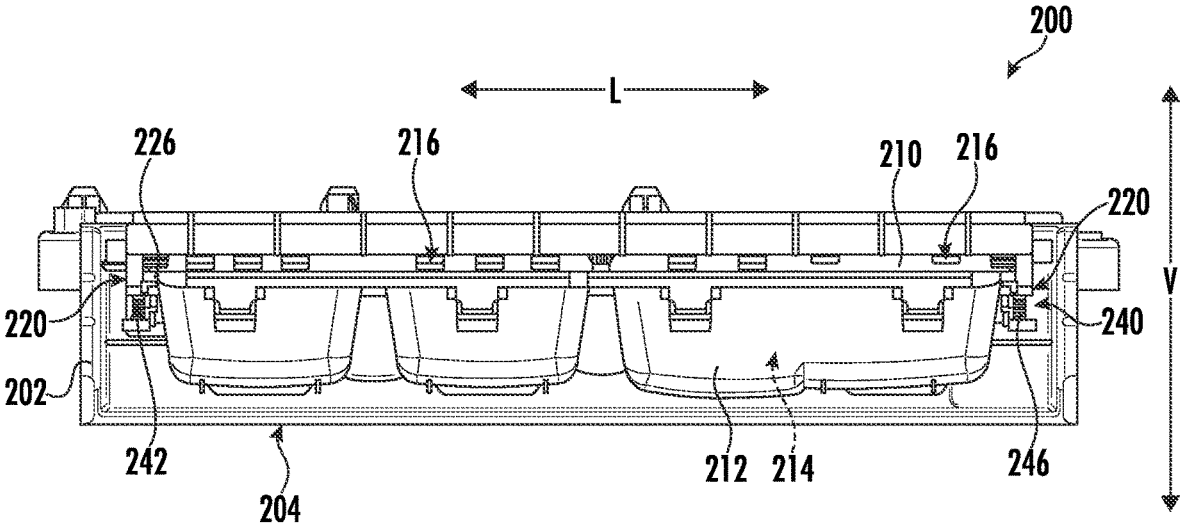
FIG. 5 provides a front view of the exemplary dispensing assembly of FIG. 4 according to an exemplary embodiment of the present subject matter.

As best shown in FIGS. 4 and 5, dispensing assembly 200 may further include a shower plate 210 that is positioned within or mounted to dispenser box 202. Below shower plate 210 is a detergent drawer 212 that is slidably received within a dispenser box 202. As shown, detergent drawer 212 may define a plurality of detergent reservoirs 214 that are configured for receiving various wash additives or detergent. In this manner, a user may slide dispenser box out toward an extended position in order to supply detergent or other wash additives into detergent reservoirs 214. After detergent reservoirs 214 are filled with the desired wash additives, detergent drawer 212 may be pushed back into dispenser box 202.

During an operating cycle of washing machine appliance 100, the flow of water may be supplied to shower plate 210, e.g., using water control valves 166 or any other suitable flow regulating devices. Specifically, the flow of water may be provided on to a top side of shower plate 210, which may define one or more reservoirs for dispersing the water along the top side of shower plate 210. In addition, as best shown in FIG. 5, shower plate 210 may define a plurality of water supply apertures 216 that pass through shower plate 210 for dispensing the flow of water into one or more of the detergent reservoirs 214. The flow of water may mix with and flush out detergent stored within a particular detergent reservoir 214 through one or more discharge apertures (not shown) defined through a bottom of detergent drawer 212. In this regard, the flow of water and detergent may generate a wash fluid that exits detergent drawer 212 and flows onto bottom floor 204 of dispenser box 202 before being directed into wash basket 114.

Notably, conventional washing machine dispensing assemblies include detergent drawers that are slidably received directly on a dispenser box. However, mounting a detergent drawer against a sloped bottom surface of a dispenser box results in the detergent drawer sliding down when being pulled out of the dispenser box. In addition, conventional dispensing assemblies include detergent drawers that wobble excessively or bind within the dispenser box while sliding in and out. These issues may generate significant consumer dissatisfaction as well as functional failure of the dispensing assemblies. Accordingly, aspects of the present subject matter are directed to features for improved engagement between detergent drawers and dispensing assemblies.

Figure 6:
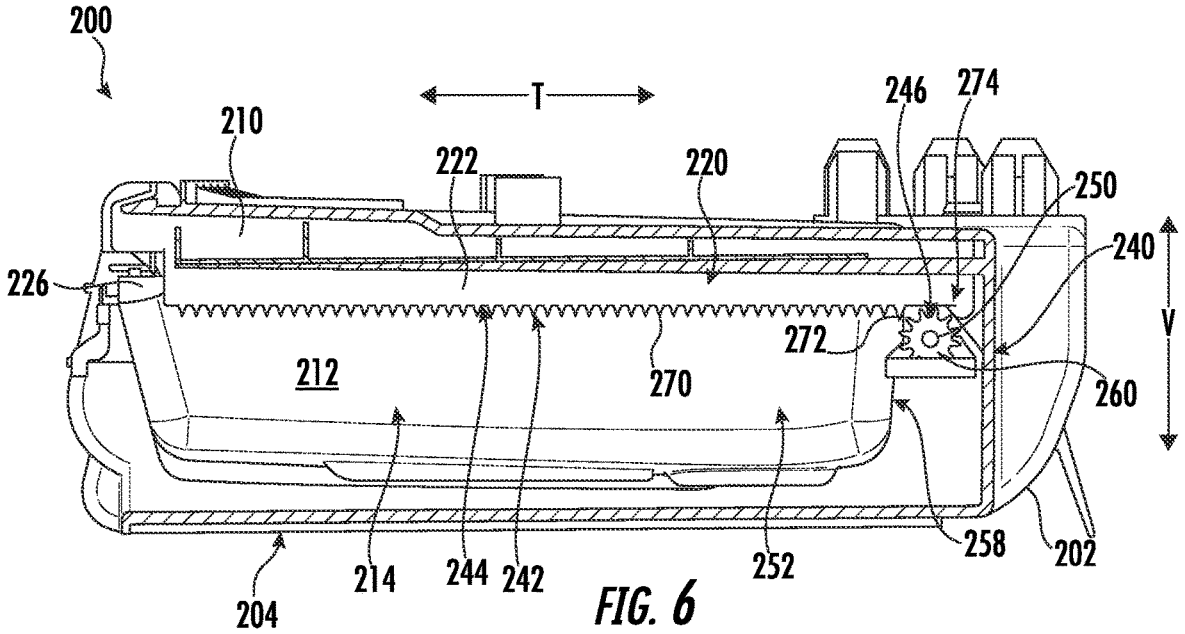
FIG. 6 provides a side, cross-sectional view of the exemplary dispensing assembly of FIG. 4 according to an exemplary embodiment of the present subject matter.
Figure 7:
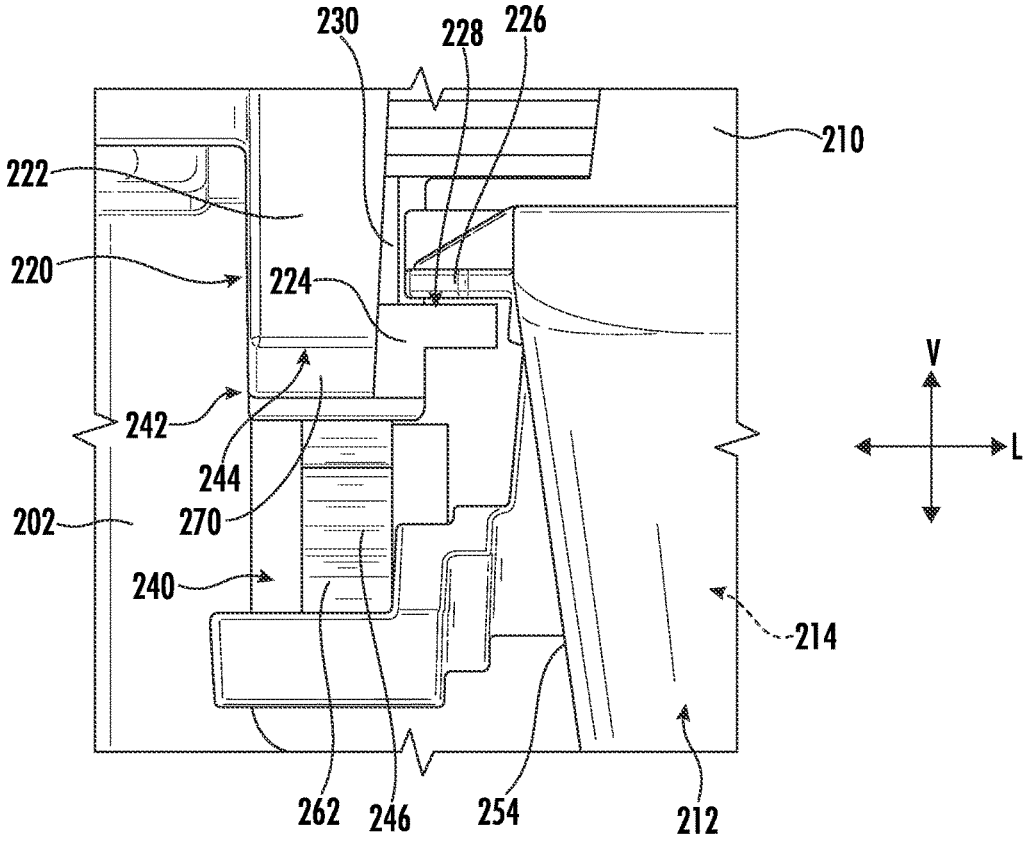
FIG. 7 provides a close-up view of a rack and pinion system of the exemplary dispensing assembly of FIG. 4 according to an exemplary embodiment of the present subject matter.

For example, according to an exemplary embodiment of the present subject matter, dispensing assembly 200 may include a plurality of lateral suspension arms 220 that extend downward from shower plate 210 along the vertical direction V. In addition, lateral suspension arms 220 may be rigidly attached to shower plate 210 or may be formed as a single, integral piece (e.g., by injection molding is described below) with shower plate 210. Lateral suspension arms 220 may generally be configured for slidably receiving detergent drawer 212 (e.g., on each lateral side) and for providing improved motion of detergent drawer 212 between an extended position (e.g., as shown in FIG. 4) and a retracted position (e.g., as shown in FIG. 6). Moreover, it should be appreciated that detergent drawer 212 may be fully suspended within dispenser box 202, e.g., such that it is not in contact with dispenser box 202.

It should be appreciated that various features of dispensing assembly 200 may be formed from any suitably rigid material. For example, according to exemplary embodiments, shower plate 210 and the lateral suspension arms 220 may be formed by injection molding, e.g., using a suitable plastic material, such as injection molding grade Polybutylene Terephthalate (PBT), Nylon 6, high impact polystyrene (HIPS), or acrylonitrile butadiene styrene (ABS). Alternatively, according to the exemplary embodiment, these components may be compression molded, e.g., using sheet molding compound (SMC) thermoset plastic or other thermoplastics. According to still other embodiments, portions of dispensing assembly 200 may be formed from any other suitable rigid material.

As will be described in more detail below, dispensing assembly 200 may include various features for improving the movement between detergent drawer and 212 and lateral suspension arms 220. For example, according to the illustrated embodiment, each of the lateral suspension arms 220 may generally include one or more vertical support members 222 that extend down from shower plate 210 and a horizontal guide bar 224 is mounted to a distal end of vertical member 222 and which extends along the transverse direction T. Specifically, according to the illustrated embodiment, each horizontal guide bar 224 extends in a horizontal plane and toward a center of dispenser box 202 along the lateral direction L. In addition, detergent drawer 212 may define lateral support flanges 226 that extend outward along the lateral direction L for engaging lateral suspension arms 220. In this regard, as best shown for example in FIG. 9, lateral support flanges 226 may receive vertical support from an upper surface 228 of the respective horizontal guide bar 224. In this manner, detergent drawer 212 may generally slide directly along the transverse direction T into and out of the dispenser box 202.

Figure 9:
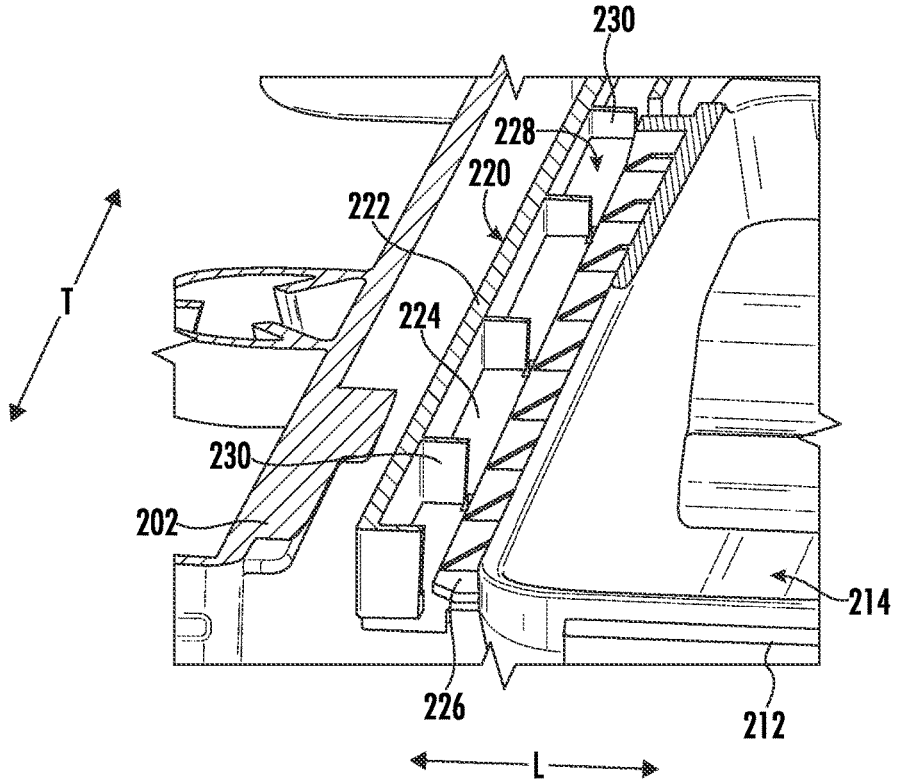
FIG. 9 provides a perspective, cross-sectional view of the exemplary dispensing assembly of FIG. 4 according to an exemplary embodiment of the present subject matter.
Figure 10:
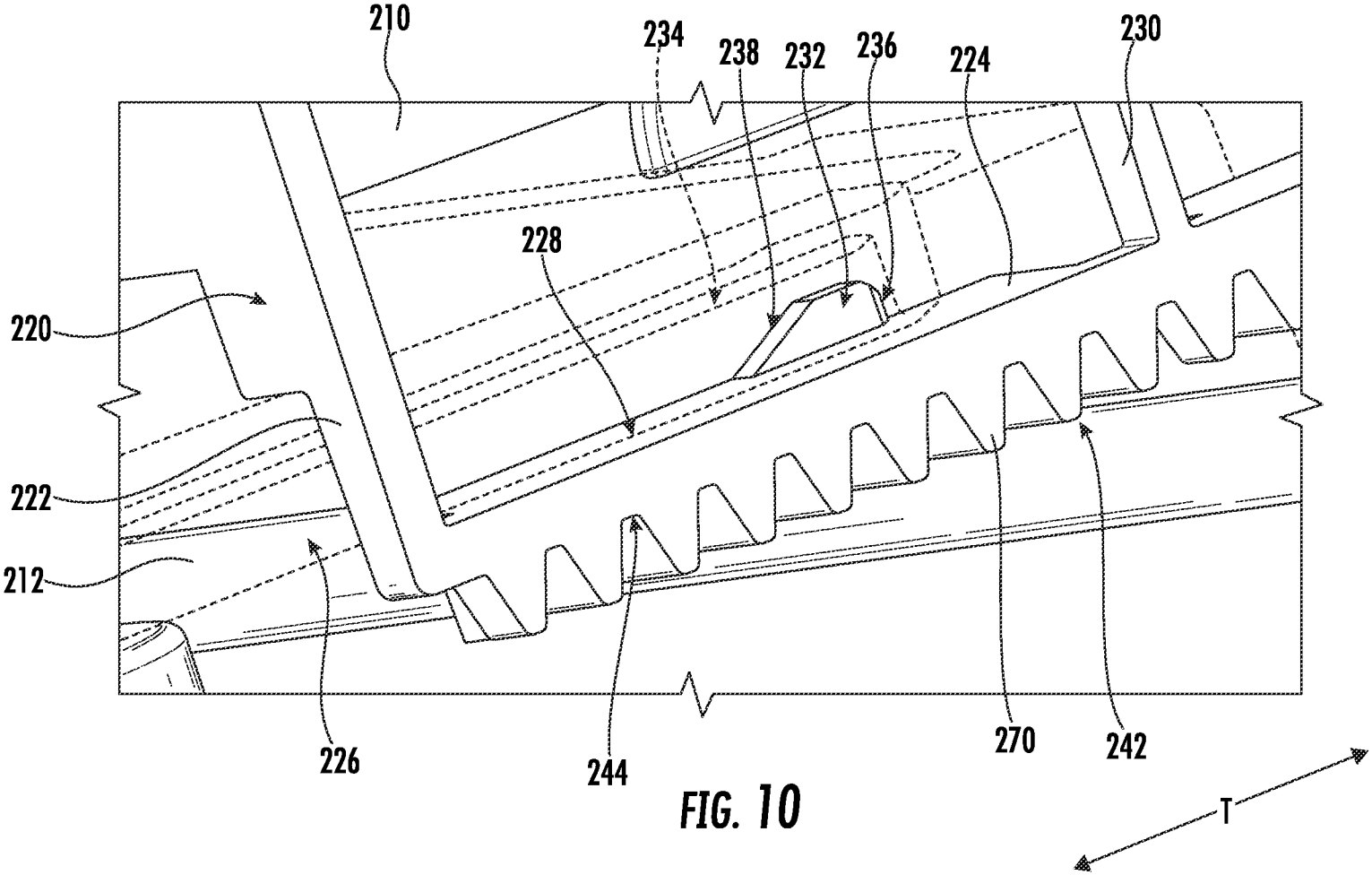
FIG. 10 provides a close-up view of a mechanical stopping mechanism of the exemplary dispensing assembly of FIG. 4 according to an exemplary embodiment of the present subject matter.

Referring still to FIG. 9, lateral suspension arms 220 may further include a plurality of alignment ribs 230 that extend from the vertical support members 222 toward detergent drawer 212 to minimize the ability of detergent drawer 212 to rotate within a horizontal plane. In this regard, for example, alignment ribs 230 may extend inward to define a tight tolerance between lateral suspension arms 220 and detergent drawer 212. Specifically, alignment ribs 230 may be sized and positioned such that a compartment width is defined along the lateral direction L between an innermost portion of alignment ribs 230 from a first arm of the lateral suspension arms 220 to a second arm of the lateral suspension arms 220. In addition, a drawer width may be defined by detergent drawer 212 along the lateral direction L between distal ends of each of lateral support flanges 226. According to exemplary embodiments, the compartment width may be greater than the drawer width by only a very small percentage, such as less than 10%, less than 5%, less than 3%, less than 1%, less than 0.5%, less than 0.1%, etc.

Dispensing assembly 200 may further include features for preventing the unintended removal of detergent drawer 212 from dispenser box 202. In this regard, for example, lateral suspension arms 220 may define one or more mechanical stopping features 232 that are intended to prevent the removal of detergent drawer 212 without pivoting or manipulating detergent drawer 212. In this regard, for example, mechanical stopping feature 232 may be a protrusion defined on upper surface 228 of horizontal guide bar 224. In addition, a receiving slot or groove 234 may be defined in a bottom side of each lateral support flange 226. In this manner, mechanical stopping features 232 may slide within groove 234 as detergent drawer 212 moves between the extended and retracted position. However, mechanical stopping feature 222 may define a vertical surface 236 for engaging lateral support flanged 226 proximate a rear end of groove 234 to prevent removal of detergent drawer 212 past the extended position. In addition, as illustrated, mechanical stopping feature 232 may define a ramped surface 238 to facilitate installation of detergent drawer 212. Notably, while interaction between lateral support flanges 226 and vertical surface 236 of mechanical stopping feature 232 prevents unintended removal of detergent drawer 212, it should be appreciated that a user may still remove detergent drawer by lifting and pulling detergent drawer 212 to remove mechanical stopping feature 232 from groove 234.

Referring now to FIGS. 4 through 8, dispensing assembly 200 may further include a rack and pinion system 240 that operably couples detergent drawer 212 to the lateral suspension arms 220. Rack and pinion system 240 may generally be configured for ensuring that detergent drawer 212 does not bind within lateral suspension arms 220 as it is moved between a retracted position and an extended position. In addition, the use of rack and pinion system 240 may provide improved mechanical engagement of the detergent drawer 212 and better structural feel by the user.

Figure 8:
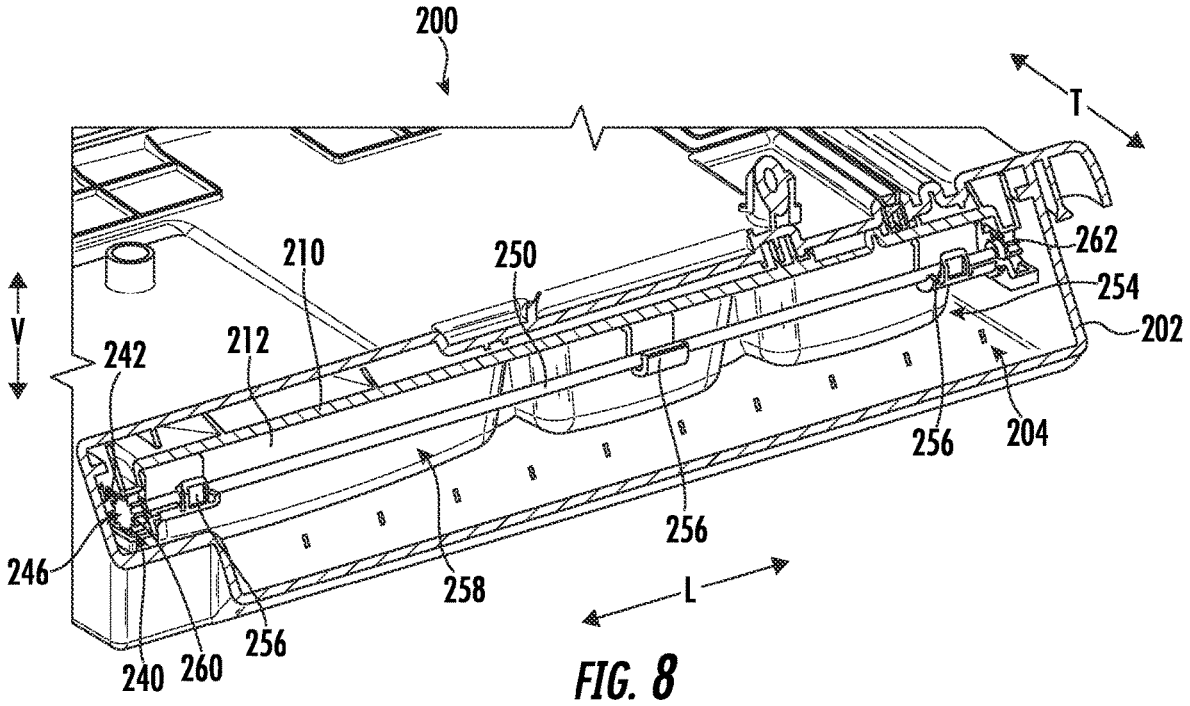
FIG. 8 provides a perspective view of a rack and pinion system of the exemplary dispensing assembly of FIG. 4 according to an exemplary embodiment of the present subject matter.

According to the illustrated embodiment, rack and pinion system 240 includes a geared rack 242 defined on a lower surface 244 of at least one of lateral suspension arms 220. More specifically, according to the illustrated embodiment, geared racks 242 are defined on each of horizontal guide bars 224. In addition, rack and pinion system 240 may include a plurality of pinions (e.g., as identified generally by reference numeral 246) that are rotatably mounted to lateral sides of detergent drawer 212 for engaging geared racks 242. More specifically, as best shown in FIG. 8, rack and pinion system 240 includes a shaft 250 that extends between a first side 252 and a second side 254 of detergent drawer 212 along a lateral direction L. Specifically, according to the illustrated embodiment, detergent drawer 212 may include one or more receiving clips 256 that are defined on a rear 258 of detergent drawer 212. As illustrated, shaft 250 may be snapped into receiving clips 256 such that it is rotatable relative to detergent drawer 212.

In general, shaft 250 may serve to transmit torque between pinions 246, e.g., to ensure that they are moved at the same rate along geared racks 242. In this manner, rack and pinion system 240 may ensure smooth movement of detergent drawer 212 along the transverse direction T while preventing detergent drawer 212 from pivoting within a horizontal plane and binding within lateral suspension arms 220. In this regard, a first pinion 260 may be mounted to a first end of shaft (e.g., proximate a first side 252 of detergent drawer 212) and a second pinion 262 may be mounted to a second end of shaft 250 (e.g., proximate a second side 254 of detergent drawer 212). First pinion 260 and second pinion 262 may be fixed to shaft 250 such that they may rotate along with shaft 250 and shaft 250 may be rotatably mounted within receiving clips 256. For example, shaft 250 may define flat edges on each lateral end that, e.g., to form a D-shape. Similarly, first pinion 260 and second pinion 262 may define a complementary aperture for receiving a respective end of shaft 250. In this manner, the keyed structure ensures that the teeth on first pinion 260 and second pinion 262 are aligned to each other. In this manner, shaft 250, first pinion 260, and a second pinion 262 all rotate at the same rate and ensure that the first side 252 and the second side 254 of detergent drawer 212 move at the same rate into and out of the dispenser box 202.

Referring now specifically to FIG. 6, rack and pinion system 240 may include further features for ensuring that pinions 260 engage geared racks 242 as desired. For example, according to an exemplary embodiment, each geared rack 242 may include a plurality of gear teeth (e.g., identified generally by reference numeral 270). According to the illustrated embodiment, a rear tooth 272 of the plurality of gear teeth 270 is longer than the remaining teeth 270. In this manner, as a user pushes detergent drawer 212 toward the fully retracted position, pinions 260 engage rear tooth 272 and provide a tactile feedback to the user that they have reached the end of geared rack 242. In addition, horizontal guide bars 224 may define a gear relief surface 274 that is defined on an opposite side of rear tooth 272 relative to the forward gear teeth 270. In general, gear relief surface 274 is a region where gear teeth 270 are not defined such that pinions 260 may rotate freely. When detergent drawer 212 is in the fully retracted position, pinions 260 may be seated against gear relief surface 274. In this manner, as a user pulls forward on detergent drawer 212 from the retracted position, pinions 260 have a tendency to engage geared racks 242 uniformly and before there is any rotation of detergent drawer 212 within the dispenser box 202.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the vertical, lateral, and transverse directions are mutually perpendicular, the washing machine appliance comprising:

a wash tub positioned within a cabinet;

a wash basket rotatably mounted within the wash tub and defining a wash chamber configured for receiving a load of clothes; and a dispensing assembly for providing a flow of wash fluid into the wash tub, the dispensing assembly comprising:

a dispenser box mounted above the wash basket;

a shower plate positioned within the dispenser box and defining a plurality of water supply apertures;

lateral suspension arms that extend downward from the shower plate along the vertical direction;

a detergent drawer defining one or more detergent reservoirs and being directly supported by the lateral suspension arms such that water supplied through the water supply apertures is directed into the one or more detergent reservoirs; and a rack and pinion system operably coupling the detergent drawer to the lateral suspension arms.

2. The washing machine appliance of claim 1, wherein the rack and pinion system comprises:

a rack defined on a lower surface of at least one of the lateral suspension arms; and a pinion rotatably mounted to the detergent drawer for mechanically engaging the rack.

3. The washing machine appliance of claim 2, wherein the rack comprises a plurality of gear teeth, and wherein a rear tooth of the plurality of gear teeth is longer than remaining teeth of the plurality of gear teeth.

4. The washing machine appliance of claim 2, wherein the rack comprises a plurality of gear teeth, and wherein the pinion rotates past a rear tooth of the plurality of gear teeth when the detergent drawer is in a fully retracted position.

5. The washing machine appliance of claim 1, wherein the rack and pinion system comprises:

a first rack defined on a lower surface of a first arm of the lateral suspension arms;

a second rack defined on a lower surface of a second arm of the lateral suspension arms;

a shaft that extends between a first side of the detergent drawer and a second side of the detergent drawer along the lateral direction; and a first pinion fixed to the first side of the shaft for engaging the first rack and a second pinion fixed to the second side of the shaft for engaging the second rack.

6. The washing machine appliance of claim 5, wherein one or more receiving clips are defined on a rear of the detergent drawer, and wherein the shaft is snap-fit into receiving clips.

7. The washing machine appliance of claim 1, wherein each of the lateral suspension arms comprises a vertical member and a horizontal guide bar that extends along the transverse direction, and wherein the detergent drawer defines lateral support flanges that are slidable along the horizontal guide bars.

8. The washing machine appliance of claim 7, wherein the vertical members of the lateral suspension arms are spaced apart along the lateral direction to define a compartment width measured along the lateral direction, the lateral support flanges define a drawer width measured along the lateral direction, and wherein the compartment width is less than 5% greater than the drawer width.

9. The washing machine appliance of claim 7, further comprising:

a mechanical stopping feature defined on at least one of the shower plate or the horizontal guide bars, wherein the detergent drawer engages the mechanical stopping feature when the detergent drawer reaches an extended position.

10. The washing machine appliance of claim 9, wherein the mechanical stopping feature is defined on the horizontal guide bar and is received within a groove defined in a bottom of lateral support flanges of the detergent drawer such that the mechanical stopping feature engages the lateral support flanges at a rear of the groove to stop further movement of the detergent drawer.

11. The washing machine appliance of claim 1, wherein the detergent drawer is not in contact with the dispenser box.

12. The washing machine appliance of claim 1, wherein the shower plate and the lateral suspension arms are injection molded as a single, integral piece.

13. The washing machine appliance of claim 1, wherein the washing machine appliance is a top load washing machine appliance.

14. A dispensing assembly for providing a flow of wash fluid into a wash tub of a washing machine appliance, the dispensing assembly comprising:

a dispenser box mounted above the wash tub;

a shower plate positioned within the dispenser box and defining a plurality of water supply apertures;

lateral suspension arms that extend downward from the shower plate along a vertical direction;

a detergent drawer defining one or more detergent reservoirs, the detergent drawer being directly supported by the lateral suspension arms such that water supplied through the water supply apertures is directed into the one or more detergent reservoirs; and a rack and pinion system operably coupling the detergent drawer to the lateral suspension arms.

15. The dispensing assembly of claim 14, wherein the rack and pinion system comprises:

a rack defined on a lower surface of at least one of the lateral suspension arms; and a pinion rotatably mounted to the detergent drawer for mechanically engaging the rack.

16. The dispensing assembly of claim 15, wherein the rack comprises a plurality of gear teeth, and wherein a rear tooth of the plurality of gear teeth is longer than remaining teeth of the plurality of gear teeth.

17. The dispensing assembly of claim 15, wherein the rack comprises a plurality of gear teeth, and wherein the pinion rotates past a rear tooth of the plurality of gear teeth when the detergent drawer is in a fully retracted position.

18. The dispensing assembly of claim 14, wherein the detergent drawer is not in contact with the dispenser box.

19. A washing machine appliance defining a vertical direction, a lateral direction, and a transverse direction, the vertical, lateral, and transverse directions are mutually perpendicular, the washing machine appliance comprising:

a wash tub positioned within a cabinet;

a wash basket rotatably mounted within the wash tub and defining a wash chamber configured for receiving a load of clothes; and a dispensing assembly for providing a flow of wash fluid into the wash tub, the dispensing assembly comprising:

a dispenser box mounted above the wash basket;

a shower plate positioned within the dispenser box and defining a plurality of water supply apertures;

lateral suspension arms that extend downward from the shower plate along the vertical direction, wherein each of the lateral suspension arms comprises a vertical member and a horizontal guide bar that extends along the transverse direction; and a detergent drawer defining one or more detergent reservoirs and being directly supported by the lateral suspension arms such that water supplied through the water supply apertures is directed into the one or more detergent reservoirs, wherein the detergent drawer defines lateral support flanges that are slidable along the horizontal guide bars.

20. The washing machine appliance of claim 19, wherein the vertical members of the lateral suspension arms are spaced apart along the lateral direction to define a compartment width measured along the lateral direction, the lateral support flanges define a drawer width measured along the lateral direction, and wherein the compartment width is less than 5% greater than the drawer width.

* * * * *